US012098501B2

(12) United States Patent
Lu

(10) Patent No.: US 12,098,501 B2
(45) Date of Patent: Sep. 24, 2024

(54) DURABLE NATURAL STRIP WEAVING PRODUCTS

(71) Applicant: Ziqiang Lu, Red Wing, MN (US)

(72) Inventor: Ziqiang Lu, Red Wing, MN (US)

( * ) Notice: Subject to any disclaimer, the term of this patent is extended or adjusted under 35 U.S.C. 154(b) by 903 days.

(21) Appl. No.: 16/735,298

(22) Filed: Jan. 6, 2020

(65) Prior Publication Data

US 2020/0217010 A1 Jul. 9, 2020

Related U.S. Application Data

(60) Provisional application No. 62/917,909, filed on Jan. 8, 2019.

(51) Int. Cl.

| | |
|---|---|
| ***D06M 15/333*** | (2006.01) |
| ***A47C 5/02*** | (2006.01) |
| ***B65D 6/08*** | (2006.01) |
| ***D03D 15/217*** | (2021.01) |
| ***D06M 101/04*** | (2006.01) |
| ***E04D 9/00*** | (2006.01) |

(52) U.S. Cl.

CPC ..... *D06M 15/333* (2013.01); *B65D 9/10* (2013.01); *D03D 15/217* (2021.01); *A47C 5/02* (2013.01); *D06M 2101/04* (2013.01); *D06M 2200/01* (2013.01); *D06M 2200/30* (2013.01); *E04D 9/00* (2013.01)

(58) Field of Classification Search

None

See application file for complete search history.

(56) References Cited

U.S. PATENT DOCUMENTS

| | | | | |
|---|---|---|---|---|
| 3,480,463 | A * | 11/1969 | Rankin | D04H 1/64 442/128 |
| 5,190,997 | A | 3/1993 | Lindemann et al. | |
| 7,868,094 | B2 | 1/2011 | Han et al. | |
| 10,174,179 | B2 | 1/2019 | Lu | |
| 2010/0120309 | A1* | 5/2010 | Arnold | D06M 15/277 442/67 |
| 2016/0115337 | A1* | 4/2016 | Lu | C09D 15/00 427/393 |
| 2018/0051412 | A1* | 2/2018 | Barik | C09D 7/63 |
| 2019/0309173 | A1 | 10/2019 | Lu | |

OTHER PUBLICATIONS

Properties and Modification Methods for Vegetable Fibers for Natural Fiber Composites (Year: 1996).*
Complete Textile Glossary (Year: 2001).*

* cited by examiner

*Primary Examiner* — Arti Singh-Pandey

(57) ABSTRACT

A natural strip or strip-based weaving or weave fabric product or a natural strip or strip-based woven product is coated and protected with a crosslinking polyvinyl acetate (XPVAc or x-PVAc) adhesive. Said adhesive is applied and cured on the exterior surfaces of said product as a first coating layer or a primer in combination with a coating layer of acrylic, alkyd, asphalt, epoxy, latex, polyurethane, silicone coatings, urethane, vinyl ester, etc. coated over the cured adhesive as a second coating layer or a topcoat. Said product is woven or fabricated with stalks, stakes, staves, stems, sticks, strands, shoots, splints, straws, strings, twigs, bark, branches, laths, leaves, rods, roots, whicker, etc. of a fiber plant, a tree, or a crop, or the combination thereof.

20 Claims, No Drawings

DURABLE NATURAL STRIP WEAVING PRODUCTS

CROSS-REFERENCE TO RELATED APPLICATIONS

The present application is a utility application claiming priority to the provisional application of No. U.S. 62/917,909 filed on Jan. 8, 2019, the disclosure and entire contents of which are incorporated herein by reference.

FEDERALLY SPONSORED RESEARCH

None.

SEQUENCE LISTING

None.

TECHNICAL FIELD

The present disclosure deals with a novel method of improving the water resistance, dimensional stability and durability of a natural strip or strip-based weaving or weave product or a natural strip or strip-based woven product in a natural environment.

BACKGROUND

A natural strip or strip-based weaving or weave product which is also known as a natural strip or strip-based woven product, is directly fabricated or woven from strands, shoots, splints, stalks, staves, straws, stems, strings, twigs, laths, bark, branches, rods, etc. of a fiber plant, tree, or crop or the combination thereof. They are extensively used for agricultural, construction, packaging, recreations, landscaping, furniture, military, etc.

However, most of the natural strips are hygroscopic. They easily absorb water and moisture and are subject to dimensional changes. In a natural environment, they are also under the attack by fungi, molds or mildews, insects, and other biodegrading agents during service, and thus resulting in reducing the service life of a natural strip weaving product.

Meanwhile, a natural strip weaving product is combustible when contacting a flame. There may be a fire risk to this material during service.

Attempts to use crosslinking polyvinyl acetate as adhesive for biomaterial-based products have been made to improve their dimensional stability. For example, an interpenetrating polymer network (IPN) adhesive disclosed in U.S. Pat. No. 5,190,997 by Lindemann et al. was used as a fiber binder of fabrics, especially as fiber filler. In the same disclosure, the patented adhesive composition had a unique feature of dual glass transition temperatures ($T_g$). Among it, a first monomer was a crosslinking polyvinyl acetate polymer with low $T_g$, while the second one was a polystyrene polymer with high $T_g$. Both then formed into an IPN polymer emulsion through chemical synthesis.

When such an adhesive composition was used as the fiber filler of a nonwoven fabric, the large $T_g$ difference between crosslinking polyvinyl acetate and polystyrene resulted in a creeping issue due to temperature and humidity changes in an indoor or outdoor condition. Accordingly, Lindemann et al.'s IPN adhesive was generally at risk of easy peel off within a short exposure period to an adverse environment or a wet and dry condition when used as a surface protective coating for a natural fabric product.

On the other hand, the IPN adhesive used by Lindemann et al. was relatively small in molecular weight before being crosslinked and cured to meet the filling requirement. In such a way, it easily penetrated into the fibrils, fibers or yarns of a fabric to work as fiber filler, thus resulting in a discontinuous coating film on the exterior surfaces of a natural fabric. Therefore, the IPN adhesive would be generally unsatisfactory to seal the exterior surfaces of the fabric and protect the fabric when used as a surface protective coating for the natural fabric product.

In U.S. Pat. No. 7,868,094 by Han et al., a foamed crosslinking polyvinyl acetate adhesive was used to bond a wood composite material including plywood, chipboard, orientated strand board, particle board, high density fiberboard, hardboard and the like. Because of the foaming defect, this adhesive was unable to be used as a protective coating to seal the exterior surfaces of a wood or fabric material. Hence, the foamable crosslinking polyvinyl acetate adhesive cannot provide an effective water resistance to a coated natural fabric product because the adhesive cannot fully cover and seal the exterior surfaces of the natural fabric material.

The present disclosure provides a feasible solution to the above issues for a natural strip or strip-based weaving or weave product or a natural strip or strip-based woven product in order to improve its performance and durability in the natural environment.

BRIEF SUMMARY

A natural strip weaving or weave product or a natural strip woven product is fabricated or woven by the strips made from a fiber plant, tree, or agricultural crop, or the combination thereof. In the present disclosure, strips are longitudinal in shape and used as weave elements or units. The strips may be harvested or obtained from a fiber plant, a tree, or a crop, including stalks, stakes, staves, stems, sticks, strands, shoots, splints, straws, strings, twigs, bark, branches, laths, leaves, rods, roots, whickers, etc., or the combination thereof. Alternatively, strips may be further cut, sliced or separated into a smaller size from the stalks, stakes, staves, stems, sticks, branches, etc. A natural strip weaving product is usually stiffer than a natural fiber fabric product, but may be more flexible than a wood or wood composite product.

In the present disclosure, the strips are the main weave or weaving elements or units of the resultant natural strip weaving fabric products. The strips may be different in dimension and size. For example, the cross section of a strip may be round or circle, ellipse, triangle, square, rectangle, quadrilateral, hexagon, diamond, trapezoid, lattice, etc. Alternatively, a strip may be solid or hollow in core. Alternatively, a strip may be used as a whole or cut as half or partial in shape (e.g., the whole or part of the cross section of the strip). These are just examples.

The species of a fiber plant, tree, or crop used for these strip weave or weaving elements or units may include cotton, sisal, kenaf, hemp, jute, flax, reed, sorghum, sugarcane, ramie, henequen, palm or oil palm, coir, corn, milkweeds, nettles, pina, grass, seagrass, raffia, rattan or cane, rush, straw, bamboo, wood, etc.

The strips for most of the aforementioned fiber plant, tree, or crop may contain cellulose, lignin, and hemicellulose. For the present disclosure, the cellulose content in the natural strips of a fiber plant, a crop or a tree is in a range of about 10% to about 85%, about 15% to about 30%, about 35% to about 50%, or about 55% to about 75%.

Finally, the aforementioned strips are woven or fabricated into a weave structure or pattern. Among this structure, the warp and weft strips are normally intersected as a weave knot at a right angle in a natural strip weaving fabric product. Alternatively, they may form any other angles to each other at the intersections or the weave knots with a range of about 0° to about 180°, depending on the design requirement of a weave structure. Alternatively, the warp and weft strips may be formed as +15°/−15°, +30°/−30°, +45°/−45°, +60°/−60°, or +75°/−75° to the longitudinal axis of a natural strip or strip-based weaving fabric product.

For a natural strip weaving fabric product, there are mainly three types of basic weaves, including plain weave, twill weave, and satin weave. A twill weave may be 2/1, ½, 2/2, ⅓, 3/1, etc. Alternatively, a natural strip weaving fabric product may use other different weave structures, including basket weave, rib weave, waffle weave, compound weave, lace weave, crepe weave, loom controlled double weave, loom controlled pile weave, etc.

A natural strip weaving fabric product may be woven by identical strip materials. Alternatively, it may be fabricated with different strip materials. For example, the weave structure of a natural strip-weaving fabric product may include bamboo and rattan strips, wood and reed strips, bamboo and seagrass strings, rice straws and corn stalks, etc. The mixing ratios of different strip materials in the fabric product may vary.

For this disclosure, part of the weave components may be a non-organic material. For instance, reed, willow, or rattan warp strips may be woven with metal or alloy weft strings or threads to form into a fence. The metal strings may be steel, aluminum, copper, etc. Alternatively, a mat may consist of bamboo warp strips and steel or aluminum weft strings. These are just examples.

Alternatively, the metal strips or strings may be substituted with thermoplastic materials. The thermoplastics may include polyethylene (PE), polypropylene (PP), polyvinyl chloride (PVC), polyester, polyethylene terephthalate (PET), polybutylene terephthalate (PBT), nylon, polyether ether ketone (PEEK), etc. For example, a fence may be fabricated with bamboo warp strips and PP weft strips or with bamboo warps and PVC wefts. Alternatively, a mat may be woven by rattan warp strips and PVC weft strips, or vice versa. Alternatively, a basket may be woven by wood warp strips and PVC weft strips, or vice versa. These are just examples.

Alternatively, the weft and warp strips may be accompanied with man-made or non-natural materials without changing the weaving pattern. For instance, staples, screws or nails may be used to fasten the weave strips at the weave knots or the intersection areas. The staples may be made from a metal or alloy material, including steel, iron, aluminum, zinc, copper, etc. For instance, a wood lattice fence has a plain weave pattern but each weave knot is fixed at the weave intersections with a metal staple, screw, nail, or the like.

Alternatively, the aforementioned metal or alloy staples, screws or nails may be substituted with pure plastic or fiberglass or carbon fiber-reinforced plastic counterparts. The plastic type may be epoxy, polyester, high density polyethylene (HDPE), PET, PP, PVC, nylon, etc.

Alternatively, the warp and weft strips at a weave knot may be fastened by using a plastic zip tie. The plastic zip tie may be made from HDPE, PET, PBT, PP, PVC, nylon, etc. For instance, a wood frame has a plain weave pattern. The wefts and warps at each weave knot may be fastened with plastic zip ties.

Alternatively, the strips at a weave knot may also be fastened or fixed with a metal-based, alloy-based, plastic-based, or polymeric-based string, rope, thread, etc.

For thicker and stiffer strips, the weave structure of a natural strip or strip-based weaving product can be simplified as a first layer of warp strips and a second layer of the weft strips. The intercepted warp and weft strips at each weave knot are then fixed or fastened by a staple, nail, screw, or zip tie. Alternatively, the fastening materials may be the same string, rope, or thread as aforementioned.

A novel waterproofing composition for the present disclosure is applied on a natural strip or strip-based weaving fabric product and may include one to multiple coating layers. The first coating layer is a Type I or Type II crosslinking polyvinyl acetate adhesive (XPVAc or x-PVAc) which acts as a primer and a protective coating to seal at least one portion of the exterior surfaces of a strip weaving fabric product and is then cured. Herein, a Type I adhesive is waterproofing, while a Type II adhesive is water resistant. An additional layer of crosslinking polyvinyl acetate may be further applied as a topcoat or an exterior layer.

Alternatively, the natural strip weaving fabric product is only coated with one layer of crosslinking polyvinyl acetate when used indoors or outdoors.

Alternatively, a regular paint or coating like acrylic, alkyd, asphalt, epoxy, lacquer, emulsion polymer isocyanate (EPI), polyester, polyurethane, or vinyl ester may be applied over the cured crosslinking polyvinyl acetate primer as a second coating layer or a topcoat.

Alternatively, multiple layers of the aforementioned regular paints or coating may be further applied on the cured crosslinking polyvinyl acetate primer.

For the present disclosure, crosslinking polyvinyl acetate is not only an adhesive to a natural strip weaving fabric product or a natural strip woven product when applied and cured, but it also acts as a protective coating for the fabric product. The crosslinking polyvinyl acetate at least includes a polyvinyl acetate-based adhesive resin, a crosslinking agent, and a catalyst when applied and cured. In addition, crosslinking polyvinyl acetate is a Type I or Type II adhesive, depending on the applications of the resultant natural strip weaving fabric product. Moreover, the crosslinking polyvinyl acetate coating is not only a primer, but it can also be a topcoat of the fabric product. The solid content of a crosslinking polyvinyl acetate adhesive is at least about 10%.

A crosslinking polyvinyl acetate adhesive may be coated on a natural strip or strip-based weaving product by an adhesive or glue spreader. Alternatively, other suitable coating methods may include spray coating, brush coating, extrusion coating, impregnation soaking, dipping, curtain coating, etc.

Alternatively, the crosslinking polyvinyl acetate can also be applied on a natural strip or strip-based weaving product by manual brushing or roller coating.

Prior to coating with a crosslinking polyvinyl acetate adhesive, a natural strip weaving fabric product may be preheated by passing through a heating unit, tunnel or facility. The heating sources for the heating unit may include electrical, microwave, steam, hot water, solar, oil heating, ceramic heating, and the like. Alternatively, the fabric product may not be pre-heated. These are just examples.

The heating unit is installed within an appropriate distance to the coated fabric substrate. Alternatively, the coated fabric product may be cured without heating.

A natural strip weaving fabric product may be pre-treated with a chemical preservative or biocide additive, including a copper-, chromium-, arsenic-, zinc-, tin-, or titanium-based compound or complex, a boron-, nitrogen-, sulfur-, chloride-, phosphate-, or silicate-based compound or complex, or the combination thereof. The preservative or biocide significantly improves the decay resistance of the natural strip-weaving fabric product to fungi, molds or mildews, termites, and ants and the durability of the resultant product. Moreover, a crosslinking polyvinyl acetate adhesive may be applied and cured on the exterior surfaces of the preservative-treated fabric product to seal and fix the preservative or its active ingredients by bonding and chelating with the preservative.

Alternatively, a natural strip weaving fabric product may be pre-treated with a chemical fire or flame retardant additive, including a zinc-, magnesium-, or aluminum-based compound or complex, a boron-, sulfur-, chlorine-, fluorine-, phosphorus-, or silicon-based compound or complex, or the combination thereof. The fire retardant additive may significantly improve the fire retardancy or resistance of the natural strip-weaving fabric product. Moreover, a crosslinking polyvinyl acetate adhesive may be applied and cured on the exterior surfaces of the fire retardant-treated fabric product to seal and fix the fire retardant or its active ingredients by bonding and chelating with the fire retardant.

Alternatively, the cured Type I or Type II crosslinking polyvinyl acetate coating layer may be further coated with one, two or multiple layers of a regular paint or coating including acrylic, alkyd, asphalt, epoxy, emulsion polymer isocyanate, lacquer, latex, polyester, polyurethane, urethane, etc.

For this disclosure, hence, a natural strip weaving fabric product or a natural strip woven product is tightly sealed by the crosslinking polyvinyl acetate to prevent the penetration of water, vapor, mist or moisture condensation, or other wetting issues. Moreover, introduction of crosslinking polyvinyl acetate as a protective coating significantly reduces the water absorption by a natural strip weaving fabric product, thereby improving its water resistance and durability in a natural environment during service.

DETAILED DESCRIPTION

Different from a natural fabric or textile product which has been disclosed in the prior art of US20190309173, a natural strip weaving fabric product is directly fabricated or woven with the weave or weaving elements or units which are normally obtained or made from a fiber plant, tree, or agricultural crop, including stalks, stakes, staves, stems, sticks, strands, shoots, splints, straws, strings, twigs, bark, branches, laths, leaves, rods, roots, whicker, etc. For the present disclosure, the above listed weave elements, units or components of a natural strip weaving fabric product are collectively called natural strips.

Hereby, the resultant product in the present disclosure may be called a natural strip-weaving fabric, a natural strip weaving product, a natural strip weaving fabric product, a natural strip-based weaving fabric product, a natural strip weaving material; a natural strip woven fabric, a natural strip woven product, a natural strip woven material, a natural strip-based woven product, a natural strip woven fabric product; a natural strip weave fabric, a natural strip weave product, a natural strip weave fabric product, a natural strip-based weave fabric product, a natural strip weave material, etc.

In order to be distinguished from a natural textile or fabric product or a natural fiber woven fabric product, the aforementioned products are preferably called a natural strip weaving or weave fabric product, a natural strip woven product, a natural strip-based weaving or weave product, or a natural strip-based woven product in the present disclosure.

In general, a natural strip or strip-based weaving fabric product is more flexible than a wood or wood composite product since the former uses more flexible strips to form into a strip woven product and thus is relatively flexible compared with the latter. Even with the same wood material the former is not as stiff as the latter because the former uses narrow and thin wood strips or strands for weaving. This is also true in comparison with other bio-base composites like a bamboo composite, a sugarcane fiberboard, a corn-stalk composite, etc. However, a natural strip weaving fabric product is usually stiffer than a natural fiber fabric or a natural fiber-based textile product because the former uses stiffer, wider, and thicker weave elements or units.

These strip or strip-like materials may be directly obtained or made from straw, grass, seagrass, reed, banana leaves, palm leaves, raffia leaves, hemp stems, flax stems, cotton stalks, crop stalks, bamboo, rattan, wood, and the like or the combination thereof. These are just examples. The resultant products may include bags, baskets, cushions, beds, curtains, seats, blinds, sheet, fences, mats, netting, frames, roofs, furniture, tents, etc. These are just examples.

For the present disclosure, the strips are the main weave or weaving elements or units of the resultant natural strip weaving or weave fabric products. The strips may be different in dimension and size. For example, the cross section of a strip may be round or circle, square, rectangle, eclipse, triangle, cone, hexagon, diamond, quadrilateral, trapezoid, etc. Alternatively, a strip may be solid or hollow in core. As for another example, the strips of reed, rush, rattan or willow based-woven products can be round, flat oval, half-round, flat, spline, etc. Furthermore, a strip of the seagrass woven products may be twisted to form into a yarn before being used as warps or wefts. These are just examples.

Like a natural fiber weaving fabric product or a textile product, a natural strip weaving fabric product usually has a two-dimensional (2D) structure in which the thickness is less than the width and length. However, a natural strip or strip-based weaving product is usually thicker than a natural fiber or fiber-based weaving fabric product.

A natural strip weaving fabric product or a natural strip woven product is made by weaving or fabricating the strips from a fiber plant, tree, or crop or its stem section. The strips are normally distinguishable from the fibers extracted from a fiber plant, tree, or crop. The fiber plant, tree or crop which may be used for a strip material in the present disclosure includes kenaf, jute, hemp, flax, bamboo, cotton, grass, straw, corn, sorghum, sugarcane, rattan or cane, reed, wood, etc.

Alternatively, a natural strip weaving fabric product can be directly fabricated from a stalk-, rod-, stave-, or stick-like material such as reed, corn stalks, cotton stalks, sorghum stalks, sugarcane, wood twigs or branches, wood sticks, etc. or the combination thereof. These stalks may be directly obtained from the stem sections or layers of a fiber plant, tree, or crop.

In at least some embodiments, the strips may be obtained or made from rattan or cane. There are about several hundred rattan species. They belong to the Calmoideae family and mostly grow in the tropical regions of China, Indonesia, and Malaysia as well as in Africa and Australia. Rattan grows like a climbing vine. Rattan's stems are normally less than about one inch in diameter but as long as about 60 ft. to about 600 ft. in length with an average mature age of about 13 years. After harvesting, the thorny bark of rattan or cane is normally removed before it is stored in warehouse. Rattan or cane can be sliced into strips from the stem. Alternatively, it can be used as a half or whole rod in shape before weaving.

In at least some embodiments, straw may be used as the raw material of a strip weaving fabric product. Straw is mainly the stalk section of a cereal plant or a grain crop after the grain and chaff are removed. It may include rice, wheat, maize, oats, barley, rye, etc. These straw materials are also called cereal or grain straws. Because straw has less cellulose and lignin but more hemicellulose, it is lower in tensile and compressive strengths than other strip materials. The above cereal straws can be used for roofs, fences, hats, basketry, cat's house, etc.

In some of these and other embodiments, a bamboo fabric may be woven from the strands, sticks, staves, or rods which are separated or sliced from the layers of the stem or phloem section of a bamboo plant. Alternatively, young bamboo stems can also be used for weaving. These are just examples.

In at least some situations, the woody shoots, twigs, sticks, young branches, laths, or rods of some tree species may be used for fabrication of a natural strip weaving fabric product. The popular species include alder, apple, ash, beech, black ash, blackthorn, birch, elm, eucalyptus, dogwood, hazel, holly, larch, lime, magnolia, oak, plum, snowberry, sweet chestnut, sycamore, willow, etc. The resultant strip weaving fabric products may include basketry, shakers such as stick and pyramidal shakers, lanterns such as sentinel and white willow lanterns, chair or stool seats, tables, samurai chairs, fences, curtains, plant supports, arbors, coracles, screens such as hurdle and Gothic screens, etc. These are just examples.

Alternatively, a pliant twig may be called a whicker. A whicker is suitable for weaving.

Common wickers may include reed, cane, rush, willow, etc. Rush may include English and Dutch rushes. These are just examples.

In at least some situations, coconut palm sticks may be used as a weaving strip.

Alternatively, coconut palm leaves can be used for weaving. Alternatively, the coconut palm sticks and leaves can be used together as weaving materials. These are just examples.

In at least some other situations, plant or tree leaves may be used as a weaving material. The species may include artichoke, bamboo, cattail, crocosima, cordyline terminalis, daffodils, daylily, gladiolus, iris, pine needles, devil's darning needles, hard rush, New Zealand flax, raffia, spider plant, makawaw, palmetto, coconut, banana, etc. These are just examples.

In at least some cases, the roots of a tree or plant may be used as a weaving material. A root material may come from different tree species, including ash, black ash, birch, pine, oak, maple, cotton wood, poplar, willow, etc. These are just examples.

In at least some cases, bark may be used for a strip weaving fabric product including seats, mats and baskets. The tree species for bark weave may include birch, cedar, elm, hickory, willow, briar (or wild rose), pine, etc. Alternatively, the bast or inner bark of lime, elm, sweet chestnut, etc. may be suitable for weaving. These are just examples.

The strips of the aforementioned fiber plants, trees or crops mostly contain cellulose, lignin, hemicellulose and pectin. Cellulose is one of the primary composition elements for most of the fiber plants, trees or crops. However, cellulose absorbs water and moisture due to the existence of abundant hydroxyl groups in its chemical structure. Since most of the natural strips consist of cellulose in composition, they are also hygroscopic in nature. In a natural environment, hence, a natural strip weaving fabric product may absorb water and moisture like a natural fiber-weaving fabric product. It is also subject to the attack by fungi, insects, molds or mildews, and other biodegrading agents, and thus reducing its service life under the natural environment.

Lignin is accumulated between the strands of cellulose in cell walls to provide rigidity and stiffness to plant stems. For a fiber plant, tree or crop, hemicellulose acts like a glue to bond cells together into fiber bundles or blocks and binds the different layers of the plant stems together, while pectin is a structural heteropolysaccharide and abundant in the middle lamella of some fiber plants. Pectin helps bind the cells together, but may also exist in the primary cell walls. Like cellulose, these substances are also hygroscopic.

A cellulose content in the natural strips of a fiber plant, crop or tree is in a range between about 10% to about 85%, about 15% to about 30%, about 35% to about 50%, or about 55% to about 75%. The general chemical composition of fiber plants or crops is listed as below:

TABLE 1

Chemical composition of some fiber plants and crops.

| Fiber plant or crop | Cellulose % | Hemicellulose % | Lignin % | Ash % |
|---|---|---|---|---|
| Bamboo | 26-49 | 15-28 | 21-31 | 1.3-2 |
| Flax | 80 | 13 | 2 | 1 |
| Hemp | 70-77 | 17.9-22.4 | 3.7-5.7 | 0.8 |
| Sugarcane | 32-34 | 27-32 | 19-24 | 1.5-5 |
| Wood | 45-50 | 15-25 | 15-30 | 0.4-1.8 |

The significant difference between a natural strip weaving fabric product and a natural fiber weaving fabric product (e.g., a natural fabric or textile product) is that a natural strip is larger in size than a fiber even though both may be obtained from the same fiber plant, tree, or crop. For instance, a strip may be as wide as about half inch to about one inches, while a fiber is usually less than 1 mil or 0.001 inch in diameter or width. Furthermore, a strip can be as long as about three to six feet, while a natural fiber is less than about one sixth to eighth inch in length. Second, a strip material of a fiber plant, tree or crop is directly used to weave a fabric or a woven product, while natural fibers must be firstly extracted or separated from a fiber plant, tree or crop and then formed into continuous yarns or threads before they can be used for weaving. Hence, the former is easily obtained from a fiber plant or tree with less cost than the latter which needs to extract a fiber from the same fiber plant or tree. Third, a strip contains cellulose, hemicellulose and lignin in its microstructure, while since a fiber is an extracted material, cellulose is dominant in the chemical composition elements of the fiber although the fiber may contain the residuals of lignin and hemicellulose. Finally, the waste released after fiber extraction by chemical or mechanical pulping is harmful to the natural environment. Even by using a dew- or wet-retting process to extract a fiber plant or crop, the released substances or components from a fiber plant or crop may have a pollution issue. In contrast, a natural strip weaving fabric does not have such a problem.

Similarly, a natural strip weaving fabric product is also different from a wood or wood composite product. First, the former uses a strip or strip-like material to form a fabric product, while the latter is used as lumber or timber or formed into a panel or beam with different dimension.

Normally, the former is thinner and usually less than one quarter inch in thickness, while the latter varies in thickness which can be up to 6 to 24 inches depending on applications. Therefore, a natural strip weaving fabric product is more flexible than a wood or wood composite product. Second, the weft and warp strips of a natural strip weaving fabric product may not be fixed at the weave intersections. The strips are able to shift or move around the weave intersections during service. However, a wood composite product does not have this weakness. For a wood composite product, all composition units or elements are tightly bonded together for good integrity. Third, a natural strip weaving fabric product usually has voids or gaps in its weaving structure, while a solid wood or a wood composite product does not have this porosity. Hence, the former is usually lighter in weight than the latter at the same dimension. Finally, a natural strip weaving fabric product is not a structural material, but a solid wood or a wood composite product may be used as a structure material.

Like a natural fiber weaving fabric product or a textile product, a natural strip weaving fabric product may also have a warp and weft weaving structure, in which the warp and weft strips are normally intersected into a certain angle in the formed fabric product. The weft and warp strips may be called weavers or whickers. Sometimes, they are also known as spokes or stakes. The weave intersection of warp and weft strips is also called a weave knot. In general, a natural strip weaving fabric product is stiffer than a natural fiber weaving fabric product.

For a natural strip weaving fabric product, there are mainly three types of basic weave patterns. Plain weave (also known as tabby weave) is the most popular weave structure for a natural strip weaving fabric product. In a plain weave structure, each warp end is intersected by a weft pick, such that the warp ends should be equal to the weft picks. Twill is also popular for a strip weaving fabric product. A fabric product with a twill draft normally has the feature of diagonal lines in the draft. The twill may have a floating feature in which a warp end or a weft pick passes over or under two or more consecutive strips in the fabric product. There may be 2/1, ½, 2/2, ⅓, 3/1 or other twills. Satin weave is similar to irregular twills in weave structure. A fabric product with the satin weave is usually arranged to avoid the diagonal lines.

In at least some cases, a natural strip weaving fabric product may also include other weave structures such as basket weave, rib weave, waffle weave, compound weave, lace weave, crepe weave, loom controlled double weave, loom controlled pile weave, etc. These are just examples.

Alternatively, other suitable weaving structures or patterns may include randing, packing, pairing, fitching, braiding (or plait weaving), waling, slewing, French randing, Zig Zag weave, which are suitable for weaving one to three strip weave elements. All these weaving techniques may be derived or developed from the aforementioned basic weave patterns.

Alternatively, the braiding or plait weaving patterns may include hair braids, fill-the-gap plaits, compass weave plaits, catfoot plaits, two-straw plaits, arrow and whip plaits, ribbon plaits, edging plaits, spiral weaves, group link plaits, etc. These are just examples.

Alternatively, other popular weave patterns in basketry may include chase weave, continuous weave, start-stop weave, continuous twill weave, coiling, three-rod wale, three-rod coil, four-rod wale, four-rod step up, four-rod arrow, twining, decorative twining arrow, etc. These are just examples.

In at least some cases, natural strips are usually limited in length. For example, the corn stalks or wood or bamboo strips may be one to six feet long, while the rattan strips may be up to ten feet in length. The strips may form as a continuous weaving line by overlapping each other at the ends which are preferably close to a weave knot. In such a way, a short strip can become a long strip by mechanical connection. Alternatively, a staple, nail or string helps mechanically connect the ends of short strips together to form into a long strip. At the same time, this connection for strips may also provide certain strength and stiffness at the joint section.

Alternatively, short natural strips may become long strips by bonding their ends with an adhesive for longitudinal extension. These natural strips may be extended through end to end by a bonded joint, including lap joint, hook joint, dovetail joint, scarf joint, tongue-groove joint, finger joint, and other suitable joint types. These are just examples.

The adhesive may be man-made, synthetic, or naturally obtained, including urea formaldehyde (UF), melamine formaldehyde (MF), melamine urea formaldehyde (MUF), phenol formaldehyde (PF), crosslinking polyvinyl acetate (XPVAc), resorcinol formaldehyde (RF), emulsion polymer isocyanate (EPI), resorcinol phenol formaldehyde (RPF), polyurethane (PU), urethane, polymeric diphenylmethane diisocyanate (pMDI), soy protein-based glues, animal glues, etc.

In general, the natural warp and weft strips are vertically or perpendicularly intersected at a weave knot in a weaving product, but they may form any other angles to each other at the weave intersections or knots with a range of about 0° to about 180°, depending on the design and requirement of the product. Moreover, the warps or wefts can form a certain angle to one of the axes of a natural strip weaving product. For example, the warp and weft strips can be formed as +15°/−15°, +30°/−30°, +45°/−45°, +60°/−60°, or +75°/−75° to the longitudinal axis of the product. These are just examples.

In at least some embodiments, the weft and warp strips may be made from the same components or materials of a fiber plant, tree, or crop and may also have the same shape or size (e.g., the same diameter or the same cross section area). Alternatively, the warp strips can be strong and stiff stalks or sticks from a fiber plant, tree, or crop, while the weft strips can be softer and fine leaves which may be low in strength and stiffness.

In at least some embodiments, the warp and weft strips may come from different fiber plants, trees or crops, respectively, thus resulting in a hybrid weave structure. For example, the warps may be bamboo strips, while the wefts may be rattan strings, or vice versa. Alternatively, the warps may be wood strips, while the wefts may be bamboo strips, or vice versa. Alternatively, the warps may be corn stalks, while the wefts may be cereal straws. Alternatively, the warps may be reed stalks, while the wefts may be rattan or bamboo strips, or vice versa. These are just examples.

In at least some embodiments, part of the weaving elements or components may be a non-organic material. But the rule of thumb is that the majority of the weave elements must be made from natural and organic weave elements. For instance, a reed or rattan fence may be woven with reed or rattan warp strips with metal weft strings or threads. The metal strings may be steel, aluminum, copper, etc. Alternatively, a bamboo mat may be woven with bamboo warp strips and steel or aluminum weft strings. Moreover, less metal materials may be needed in the weave structure because of their better strength properties. In this way, the metal strings may bring a high strength to the hybrid weave structure. These are just examples.

Alternatively, the metal strips or strings may be substituted with thermoplastic materials. The thermoplastics may include PE, PP, PVC, polyester, PET, PBT, nylon, PEEK, etc. For example, a fence may be fabricated with bamboo warp strips and PP weft strips, or with bamboo warps and PVC wefts. Alternatively, a mat may be woven by rattan warp strips and PVC weft strips, or vice versa. Alternatively, a basket may be woven by wood warp strips and PVC weft strips, or vice versa. These are just examples.

In some other embodiments, the weft and warp strips may be accompanied with non-organic or man-made materials without changing the weaving pattern. For instance, staples, screws or nails may be used to fasten the weave strips at the weave knots. The staples may be made from a metal or alloy material, including steel, iron, aluminum, zinc, copper, etc. For instance, a wood lattice fence has a plain weave pattern but each weave knot is fixed at the weave intersections with a metal or alloy staple, screw, or nail. This helps limit the shifting or movement between or among the strips at each weave knot during service.

Alternatively, the above staples, screws or nails may be made from a pure plastic or a fiberglass or carbon fiber-reinforced plastic material. The plastic may be epoxy, polyester, HDPE, PET, PP, PVC, nylon, etc.

Alternatively, the warp and weft strips at a weave knot may be fastened by using a plastic zip tie. The material type of a plastic zip tie may be HDPE, PET, PBT, PP, PVC, nylon, etc. For instance, a wood frame has a plain weave pattern in which the wefts and warps at each weave knot are fastened with a plastic zip tie.

Alternatively, the warp and weft strips at a weave knot may be fastened or fixed with a metal-, plastic-, or polymeric-based string, rope, thread, etc.

In some of these and other embodiments, the weave structure of a natural strip or strip-based weaving product can be simplified. For thicker and stiffer strips, the warp strips may stay on one layer, while the weft strips are placed on another layer. The intercepted warp and weft strips at each weave knot are fixed or fastened by a staple, nail, screw, or zip tie. The advantage of this simplified weave structure is that a natural strip weaving product may be made with high production efficiency and low labor cost.

Except for a large scale of industrial production, natural strips are also suitable for manual weaving for manufacture of a natural strip weaving fabric product.

A natural strip weaving fabric product may need a support material to maintain its shape or dimension or to be easily carried or stored. For instance, frames, handles, feet, or rims are needed for basketry. These support materials may be made from metals, bamboo, plastics, wood, reed, etc. These are just examples.

A natural strip weaving fabric product may be bleached after fabrication. The bleached fabric product may be further dyed with different colors. Alternatively, the natural strips can be firstly bleached and then dyed with a designed color, and they are finally woven or fabricated into a weaving fabric product.

All natural strip weaving fabric products may be dyed into different colors. For example, a natural strip weaving fabric product can be black, white, red, green, blue, etc. However, dying strips may take time and labor. Before dying, the fabric material is normally treated with a strong oxidizing agent such as chlorine-based chemicals or hydrogen peroxide to provide a pure and even background. For better bonding with crosslinking polyvinyl acetate, however, a natural strip weaving fabric product is preferably not treated by any dyes.

A natural strip weaving fabric product may be pre-treated with a chemical preservative or biocide additive, including a copper-, chromium-, arsenic-, zinc-, tin-, or titanium-based compound or complex, a boron-, nitrogen-, sulfur-, chloride-, phosphate-, or silicate-based compound or complex, or the combination thereof. The preservative or biocide significantly improves the decay resistance of the fabric product to fungi, molds or mildews, termites, and ants and its durability.

Alternatively, a natural strip product may be pre-treated with a chemical fire or flame retardant additive, including a zinc-, magnesium-, or aluminum-based compound or complex, a boron-, sulfur-, chlorine-, fluorine-, phosphorus-, or silicon-based compound or complex, or the combination thereof. The fire or flame retardant additive may significantly improve the fire retardancy or resistance of the fabric product.

For the present disclosure, a crosslinking polyvinyl acetate (XPVAc or x-PVAc) adhesive or emulsion polymer is used as a protective coating to improve the water resistance and durability of a natural strip weaving fabric product. Crosslinking polyvinyl acetate is a water-based emulsion polymer. It may consist of a polyvinyl acetate-based resin, a catalyst, a crosslinking agent, a pigment, a surfactant, a biocide, etc. The polyvinyl acetate adhesive resin may also include a copolymer, including polyvinyl alcohol (PVA) and ethylene vinyl acetate (EVA).

A suitable crosslinking agent for crosslinking polyvinyl acetate is normally a bi-functional compound, which may include acrylic acid (AA), oxalic acid, glyoxal, dialdehyde glyoxal, glutaraldehyde, acrylonitrile (AN), n-butyl acrylate (BA), vinyl butyrate (VB), vinyl chloride, acetoacetoxy ether methacrylate (AAEM), diacetone acrylamide, 4-hydroxybutyl acrylate, 4-hydroxybutyl acrylate glycidylether, hexakis-(methoxymethyl)-melamine (HMMM), isopropylene alcohol, 2-hydroxyethyl acrylate, 2-ethylhexyl acrylate, glycidyl methacrylate, methyl methacrylate (MMA), N-isobutylmethylol acrylamide (NIBMA), N-methylol acrylamide (NMA), natural rubber latex, versate acid Veo Va-9 or VV 9 ($CH_2{=}CHOOCCR_3R_1R_2$) and Veo Va-10 or VV10, and the like.

Alternatively, suitable crosslinking agents may also be a mixture of vinyl acetate (VAc) with the above crosslinking agents to form a copolymer such as VAc/BA, VAc/MMA, VAc/AAEM, VAc/NIBMA, VAc/NMA, VAc/Veo Va-9, VAc/Veo Va-10, VAc/AA/AN, and the like.

Alternatively, other possible crosslinking agents with a similar structure may be the products of vinyl acetate and other monomers, including VAc/ethylene, VAc/2-ethylhexyl acrylate, VAc/polyethylene glycol dimethacrylate, and the like. The resultant crosslinking agents can help improve the water resistance of crosslinking polyvinyl acetate.

Alternatively, suitable crosslinking agents may also include butyl and methyl acrylate esters for the vinyl acetate/butyl acrylate monomer. They may be the copolymers of vinyl ester and VeoVa-10, including VeoVa-10/methyl methacrylate and VeoVa-10/methyl methacrylate/2-ethylhexylacrylate.

The catalyst of crosslinking polyvinyl acetate may include: 1) Metal ion compounds, including chromium nitrate, aluminum nitrate, aluminum chloride, antimony trichloride, iron trichloride, zirconium nitrate, potassium dichromate, chromic perchlorate, calcium chloride, sodium persulfate, potassium persulfate, basic zirconium oxychloride, bismuth oxychloride, vanadium oxychloride, etc., 2) Nonmetallic chemicals, including ammonium persulfate, hydrogen peroxide, oxalic acid, tertbutyl persulfate, etc., and 3) The combination of these compounds.

Crosslinking polyvinyl acetate can be a two-part or one-part adhesive. For a two-part crosslinking polyvinyl acetate adhesive, the adhesive emulsion and catalyst are usually separately packaged and only mixed together before being applied to a fabric substrate, while the catalyst is already pre-mixed in the adhesive emulsion for a one-part crosslinking polyvinyl acetate adhesive and ready for use. In general, a two-part crosslinking polyvinyl acetate has longer shelf life than a one-part crosslinking polyvinyl acetate. Moreover, the former is better in water resistance than the latter.

Although crosslinking polyvinyl acetate has been used as an adhesive for the wood industry, it was the first time introduced as a protecting coating for a wood or wood composite product in the prior art of U.S. Pat. No. 10,174,179. Of course, all of the fundamental principles for the crosslinking polyvinyl acetate adherent coating for wood materials in U.S. Pat. No. 10,174,179 may also apply to a natural strip weaving fabric product or a natural strip woven product.

Likewise, a crosslinking polyvinyl acetate adhesive when used as the protective coating of a natural strip weaving fabric product has the following features as mentioned by U.S. Pat. No. 10,174,179: "1) although its one adherent phase bonds to the substrate (which is necessary for a coating), the resin must form a free and continuous film on the substrate of a fabric with the other adherent phase without bonding, 2) this film only seals the exterior surface of the substrate, 3) this film must be exposed to the natural atmosphere through its nonbonding phase to work as a surface protective layer for the substrate, and 4) unlike an adhesive, this adhesive coating does not act as stress transfer between/among the adherends or the substrate elements".

According to the above principles, however, a crosslinking polyvinyl acetate adhesive should not have a foam structure which may form a non-continuous film on the fabric substrate, thus resulting in poor water resistance of the coated fabric. In addition, the copolymers or the crosslinking sections of a crosslinking polyvinyl acetate emulsion polymer should have a close glass transition temperature to avoid breaking, cracking, even peel off of the resultant coating film applied on a natural strip weaving fabric product during service.

For the present disclosure, crosslinking polyvinyl acetate is coated as a first coating layer on a natural strip weaving fabric product in order to maintain a durable performance. This new coating system may include the following coating layer structures: 1) Crosslinking polyvinyl acetate is used as a first layer or a primer to cover the natural strip weaving fabric product; 2) A second layer of crosslinking polyvinyl acetate is then applied over the cured first coating layer of crosslinking polyvinyl acetate; 3) Alternatively, crosslinking polyvinyl acetate is used as a primer, while a second coating layer (or the exterior layer) is acrylic; 4) Alternatively, alkyd is used as a second coating layer over the cured crosslinking polyvinyl acetate primer; 5) Alternatively, an epoxy coating can be used as a second coating layer to cover the cured first layer of crosslinking polyvinyl acetate; and 6) Alternatively, other water resistant coatings or paints such as asphalt, urethane, polyurethane, emulsion polymer isocyanate (EPI), epoxy and the like can also be applied as a top coating layer on the cured crosslinking polyvinyl acetate primer. The last four coating layer structures are also called a hybrid coating composition.

A regular water-resistant coating or paint which is commercially available and applicable to a natural strip-weaving fabric product may include acrylic, alkyd, asphalt, polyurethane, epoxy resins (e.g., bisphenol A, bisphenol F, novolac, aliphatic, and glycidylamine epoxy), urethane, vinyl ester, EPI, etc. Other coating materials such as silicone polyester, silicone alkyd, polyvinyllidene fluoride (PVDF), or the like may also be used for the present disclosure.

Crosslinking polyvinyl acetate may be a Type I or Type II adhesive to provide a necessary water resistance as the surface protective coating of a natural strip weaving fabric product. In order to provide a good water resistance for the fabric product, a crosslinking polyvinyl acetate coating needs to be a Type II adhesive. As a Type II adhesive, crosslinking polyvinyl acetate is water resistant and may be used in an indoor and wet condition. When crosslinking polyvinyl acetate is a Type I adhesive, it can be used in an outdoor condition.

It is preferred that a crosslinking polyvinyl acetate coating has a minimum Fruehauf wet shear strength of 175 psi when it is applied as a first coating layer or primer in combination with a regular coating or paint such as acrylic or alkyd as a second coating layer, while the crosslinking polyvinyl acetate needs to be a Type I adhesive and preferably has a minimum Fruehauf wet shear strength of 325 psi when it is directly applied as a top coating layer for a natural strip weaving fabric product. Alternatively, it is preferred that a Type I crosslinking polyvinyl acetate adhesive is at least 525 psi in Fruehauf wet shear strength when it is used as a top coating layer or a topcoat of the fabric product for outdoor exposure during service. The aforementioned Fruehauf wet shear strength data have been listed in Table 1 of U.S. Pat. No. 10,174,179. The measuring procedure and determination for the Fruehauf wet shear strength of an adhesive for the present disclosure are also referenced to U.S. Pat. No. 10,174,179.

Based on the experimental results, a Type II crosslinking polyvinyl acetate adhesive has a Fruehauf wet shear strength range from about 150 to about 300 psi, while a Type I crosslinking polyvinyl acetate adhesive has a minimum Fruehauf wet shear strength of about 300 psi. Hence, a Type I crosslinking polyvinyl acetate adhesive can be higher than 325 psi or 525 psi in Fruehauf wet shear strength to provide semi-outdoor or outdoor protection to a natural strip weaving fabric product. Accordingly, the fabric product protected with Type I and Type II crosslinking polyvinyl acetate adhesives can meet the durability requirements for a fabric product under different applications and environments. For the present disclosure, the durability of a natural strip weaving fabric product means its ability to last for a long time with the same performance or quality or it is continuously used without damage and failure during service.

The curing of crosslinking polyvinyl acetate is driven by a loss of moisture in the emulsion and/or when the moisture is dried out. For the present disclosure, the solid content of crosslinking polyvinyl acetate is at least 10% by weight.

Some natural strips may contain wax or oil substances on the exterior surfaces. For example, the fresh bamboo phloem usually has a wax layer. In addition, the natural strips of straw or reed may have silica on the exterior surfaces of the stalk section. Wax and silica may interference with the adhesion of a crosslinking polyvinyl acetate adhesive to these strips. Hence, acetone, alcohol, toluene or other chemical solvents may be needed to remove the wax or oil substances from strips before applying the crosslinking polyvinyl acetate. Sometimes, it may be suitable to use a sandpaper to rough out the exterior surfaces of the natural strips with silica to improve their bonding with the crosslinking polyvinyl acetate.

Prior to the surface coating treatment, a natural strip weaving fabric product may be air-, kiln-, or oven-dried for a certain period to reach a moisture content of less than 15%, preferably about 6% to about 12%. The dried natural fabric product is then coated with a crosslinking polyvinyl acetate adhesive as a first coating layer and a regular water resistant paint as a second coating layer. However, a natural strip weaving fabric may be coated with only one layer of crosslinking polyvinyl acetate when it is used indoors or under a shield-like protection.

Before coating with crosslinking polyvinyl acetate, a natural strip weaving fabric product can be pre-heated by passing a heating unit, a heating tunnel, or other suitable heating facilities. Pre-heating the fabric before coating may help wet the fabric product by crosslinking polyvinyl acetate and improve its adhesion with cellulose, lignin and hemicellulose, and other microstructural components of the fabric product. This may include exposing the fabric product to a heating apparatus. The pre-heating sources may be steam heating, hot water heating, oil heating, ceramic heating, IR heating, or other suitable heating facilities. These are just examples.

In at least some situations, a heating apparatus may be an infrared (IR) heater. The set temperature of the IR heater may be in a range of about 400° F. to about 1500° F. (e.g., the heating head of a heating apparatus may have a heating density of about 10 $W/in^2$ to about 1,000 $W/in^2$). This is just an example.

While preheating, a heating zone may be defined by placing a heating apparatus adjacent to a natural strip-weaving fabric product. For example, a heating apparatus (e.g., a heating head thereof) may be disposed approximately 0.5 inch to 36 inches (e.g., about 0.5 inch to about 10 inches, or about 12 inches to about 20 inches, or about 22 inches to about 32 inches) away from the fabric surface and define the heating zone in between. Alternatively, the heating unit or device may also contact the natural fabric. The alternative heating energy may include electrical, microwave, steam, hot water, solar, oil heating, ceramic heating, and the like.

Prior to coating with a crosslinking polyvinyl acetate adhesive, a natural strip weaving fabric product may be preheated until the fabric surface temperature reaches to about 80° F. to about 250° F. by passing through a heating unit or tunnel which is installed in a distance of about 0.5 inch to about 36 inches away from the coated fabric substrate. The heating sources may include electrical, microwave, steam, hot water, solar, oil heating, ceramic heating, and the like. Alternatively, the fabric product may be not pre-heated. These are just examples.

Similarly, the natural strip weaving product coated with crosslinking polyvinyl acetate may be cured at the surface temperature of about 80° F. to about 250° F. by using a heating tunnel or facility which is installed in a distance of about 0.5 inch to about 36 inches away from the coated strip weaving fabric substrate. Alternatively, the coated fabric product may be cured without heating.

In order to avoid potential risk of fire or flame on a natural strip weaving fabric product by electrical, microwave, ceramic, IR or other heating methods, the heating distance from the heating head or unit to the fabric surface and the maximum temperature should be appropriately adjusted. In this way, a burning even a flame during heating may be prevented. Sometimes, a smoke detector may be needed during preheating the fabric product.

In some other situations, the preheating process may be a continuous process where a coated strip weaving fabric product passes a heating apparatus with, for example, a conveyor or other supporting device. The natural strip weaving fabric product may be preheated so that the fabric surface temperature reaches about 80° F. to about 250° F., or about 80° F. to about 180° F., or about 130° F. to about 160° F. Preheating may occur over a suitable amount of time, which may be, for example, about 2 seconds to 10 minutes or so (e.g., 1 second to 5 minutes or so) for the coated strip or strip-based weaving fabric to pass through the heating apparatus, depending on the heating intensity used. However, preheating may not be required.

In at least some embodiments, crosslinking polyvinyl acetate may be coated on at least one of the exterior surfaces of a natural strip or strip-based weaving product by roller coating, dipping, soaking, spraying, brush coating, curtain coating, or other suitable coating methods.

Before contacting with other surfaces, the crosslinking polyvinyl acetate coating needs to be dried out or cured under an ambient or heating condition. Moreover, the curing process of crosslinking polyvinyl acetate can be accelerated with steam heating, ceramic heating, IR heating, and other suitable heating methods.

In at least some embodiments, a crosslinking polyvinyl acetate adhesive is applied and cured on the exterior surfaces of a natural strip weaving fabric product which is already pretreated with a preservative or a fire retardant as aforementioned. Thus, the cured crosslinking polyvinyl acetate coating seals and fixes the chemical or its active ingredients in the strip weaving fabric product by bonding and chelating with the chemical at the exterior surfaces or the surface layers of the fabric product. Alternatively, the strip weaving fabric product can be used without pretreatment by a preservative or fire retardant additive.

In at least some embodiments, a series of fans or box fans may be used to accelerate the curing of the crosslinking polyvinyl acetate coating on a natural strip weaving fabric product. In addition, a combination of air flow by fans and heating the coating may quickly evaporate the water or moisture in the coating, thus resulting in its fast curing.

For the aforementioned coating layer structures, only one coat of crosslinking polyvinyl acetate may be used on the exterior surfaces of a strip weaving fabric product during service, depending on the product design and application requirements.

In at least some embodiments, a crosslinking polyvinyl acetate adhesive is always used as primer or as a first coating layer on a natural strip weaving fabric product. Two coating layers may comprise a first coating layer of the crosslinking polyvinyl acetate adhesive and a second coating layer of a regular water-resistant coating or paint like acrylic, alkyd, latex, etc. on the natural strip weaving fabric product, while multiple layers or coats of a regular coating or paint may be further applied over the cured crosslinking polyvinyl acetate coating on the same fabric product.

In some other embodiments, two coating layers of crosslinking polyvinyl acetate may be firstly applied on a natural strip weaving fabric product, and then the third or multiple coating layers of a regular coating or paint such as acrylic or alkyd may be further applied over the cured crosslinking polyvinyl acetate when a high water resistance is required for the fabric product.

According to the experimental results, the crosslinking polyvinyl acetate-protected natural strip weaving fabric products can significantly improve their water resistance and effectively maintain their mechanical performance in an outdoor or an indoor condition, and thus improving their service life and durability in the natural environment.

EXAMPLES

The present disclosure may be further clarified by reference to the following examples, which serve to exemplify some of the preferred embodiments or situations, but not to limit the present disclosure in any way.

Example 1

A rice straw thatch roof is used for this example. A bundle of rice straws are fastened by metal strings or special nails on a roof frame. Likewise, a plurality of rice straws is further fixed on the frame to form as the exposed top section of the thatch roof.

A Type I crosslinking polyvinyl acetate adhesive may be sprayed or roller-coated on the roof. The coating amount may be about 0.020 lb./ft$^2$ to about 0.100 lb./ft$^2$. A coating layer of acrylic or alkyd may be further applied on the cured crosslinking polyvinyl acetate adhesive layer to cover the exterior surfaces of the rice straw thatch roof. The coating amount of acrylic or alkyd may be the same as or less than that of the adhesive primer. The adhesive and paint are preferably applied in sunny or dry days.

Example 2

Alternatively, the rice straws for the thatch roofing in Example 1 may be substituted with wheat straws, barley straws, maize straws, reed stalks, corn stalks, cotton stalks, sorghum stalks, rushes, corn husks, banana leaves, palm branches, young tree branches, palm or oil palm leaves, seagrass, etc.

Example 3

A bamboo basket is woven with bamboo strips or strands. They are about 0.125 inch to about 2 inches in width and about 0.010 inch to about 0.125 inches in thickness. For good flexibility, the strips may be cut from the inner layers of the wall of bamboo. Alternatively, the surface layers with the fresh and green skins may be used for weaving.

Normally, the top frame section of a bamboo basket is the starting point for weave. Thicker bamboo strips which are normally two to three layers thick as the regular bamboo strips are used for the frame. Since bamboo is strong and tough, regular bamboo strips may maintain the weaving shape at the bottom section without reinforcement.

The bamboo basket may be a round column or a cubic in shape. The weave pattern may be a plain weave, a twill weave, a hexagon weave, etc. The strips can be woven without gaps or with large voids, depending on the design and applications of the basket.

A Type I or Type II crosslinking polyvinyl acetate adhesive may be coated on the basket by brushing or roller coating. The coating amount may be about 0.010 lb./ft$^2$ to about 0.060 lb./ft$^2$. After the adhesive is cured, a second coating layer of acrylic or alkyd may be further applied over the cured adhesive layer on the basket with the coating amount close to that of the adhesive. The coated bamboo basket can be used in an indoor or outdoor condition.

Example 4

Alternatively, the bamboo strips in Example 3 may be substituted with wood strips. A wood strip may be made from ash, black ash, oak, birch, pine, etc. Different from bamboo, thick wood strips are normally used for basketry. The thickness of wood strips is normally about ⅛ inch to ¼ inch, depending on the wood species and the product design and applications.

Wood strips are usually not as flexible and tough as bamboo strips at the same thickness. Thick wood strips may need to have a softening treatment. The wood strips may be soaked in warm or hot water or in an ammonia solution. This pretreatment helps improve the flexibility of wood strips.

Similar to bamboo baskets, the wood basket may be a round column in shape. The weave pattern may be a plain weave, a twill weave, a hexagon weave, etc. The strips can be woven with or without gaps or voids in the weave structure, depending on the design and applications of the basket.

Example 5

A strip woven mat is made from palm leaves. The palm leaves may be continuously connected at the leave axis direction by inserting the connected leaves in the weave knots. The resultant mat is stored indoors for one week before a coating treatment.

A Type I or Type II crosslinking polyvinyl acetate adhesive may be applied on the mat with a spray pump. The coating amount may be about 0.010 lb./ft$^2$ to about 0.060 lb./ft$^2$. After the adhesive is cured, a coating layer of acrylic or alkyd may be further applied to cover the cured adhesive layer on the mat with a coating amount close to that of the adhesive primer.

Example 6

Alternatively, the palm leaves in Example 5 may be substituted with seagrass, bamboo leaves, banana leaves, grass, straw, pina, rush, New Zealand flax, etc.

Example 7

A frame material is usually prepared for fabrication of a chair seat by rattan or cane strips. The chair frame is firstly made from wood, bamboo, reed, etc. When the frame is ready, rattan or cane strips are softened in water for several hours. The rattan strips are laid as primary threads along the frame of the seat for a chair. Small metal nails may be used to attach each strip of the first rattan group at one end of the frame. All rattan strips are evenly spaced and paralleled to one another. A small gap may be allowed between the paralleled rattan strips. Similarly, one end of each strip in the second group is nailed to the other sides of the frame such that the second group strips lie vertically to the first group ones. The second group strips are further woven through the first group strips by alternating over and under. Finally, all rattan strips are woven to fully cover the nails at the frame.

After the rattan strips are dried out by air or heat, a Type I or Type II crosslinking polyvinyl acetate adhesive may be coated on the surfaces of the rattan weave. The coating amount of crosslinking polyvinyl acetate adhesive may be about 0.010 lb./ft$^2$ to about 0.060 lb/ft$^2$. After the adhesive is cured, a coating layer of acrylic or alkyd may be further applied on the cured crosslinking polyvinyl acetate coating layer of the chair with a coating amount close to that of the adhesive primer.

Example 8

Alternatively, the rattan or cane weave fabric in Example 7 may be expanded to rattan-based baskets, benches, chairs, tables, stools, ottomans, beds, wine holder, tray, loungers, or other rattan strip-based woven products.

Example 9

Two small bamboo weaving mats with a dimension of about 5.375 inches by about 8.625 inches were purchased commercially. The bamboo strips were plain and had no preservative or fire retardant treatment. The strips were about 0.35 inch to about 0.56 inch in width and about 0.020 inch to about 0.030 inch in thickness. Both mats were fabricated with a plain weave pattern. The bamboo strips were woven side by side with small gaps or porosity.

The first bamboo mat was used as control. One face of the mat was plain, while the other face was coated with acrylic. The coating amount of acrylic was about 0.010 lb./ft$^2$ to about 0.030 lb/ft$^2$.

The second bamboo mat was firstly coated with a Type I crosslinking polyvinyl acetate adhesive. The coating amount on both faces was in the range between about 0.015 lb/ft$^2$ to about 0.030 lb/ft$^2$. After the adhesive was completely cured, a second coating layer of acrylic with a coating amount of 0.010 lb./ft$^2$ to about 0.020 lb/ft$^2$ was further applied on the cured adhesive layer of one face of the second mat.

Both bamboo mats were stored at room temperature for one week. After that, both mats were hung on a wood post outdoors and kept about four feet above ground.

After outdoor exposure for three months, the uncoated surface of the control mat turned into a dark color, while the acrylic coated surface of the control mat started having micro cracks. However, all the bamboo surfaces protected with the crosslinking polyvinyl acetate coating were intact and had no mold and no cracking or checking.

After six-month outdoor exposure, the uncoated surface of the control mat became darker by molds and had surface cracking. Moreover, the control mat was deformed in shape. In contrast, the mat coated with the crosslinking polyvinyl acetate adhesive had no cracking, no mold, and no deformation in shape.

After outdoor exposure for ten months, the mold penetrated into the surface layers of the control mat and made it darker in color. Moreover, splits and cracks were further developed on the bamboo strips of the control mat, while some surface areas of the acrylic-coated control mat started cracking.

After exposed for fifteen months, however, the bamboo mat protected with the crosslinking polyvinyl acetate adhesive and covered with or without acrylic had no cracking or surface checking, no mold and no deformation in shape. Moreover, the second coating layer of acrylic over the first coating layer of crosslinking polyvinyl acetate primer on the bamboo mat was firmly stick to the primer and had no cracking and no peel off.

Example 10

Alternatively, the bamboo strip woven product in Example 9 may further include bamboo-based fences, screens, benches, chairs, beds, etc.

Example 11

Several pieces of two to three foot long fresh birch roots were dug out from soil around a birch tree. They were instantly cleaned up with water, and then the skin of each root stem was removed. All birch roots were about ¼ to ⅝ inch in diameter. The soft and flexible root stems were then cut into seven to eight-inch long sections. Three frames were woven from these root strips.

The resultant frames had a woven dimension of about six inches by about six inches. The same root materials were used as the wefts and warp strips for these frames. In this manner, the wefts and warps formed into a network structure with multiple grids which had one inch by one inch holes in dimension. In each frame, the root weft and warp strips were crisscrossed to one another. The four outside weave knots at the corners of each frame were fixed with cotton strings for easy fabrication. Each root frame had a plain weave structure.

For the woven root frames, one frame was used as control. It was plain and had no coating treatment, while the other two frames were coated with a Type I crosslinking polyvinyl acetate adhesive to completely cover the exterior surfaces of all root stem strips. After the adhesive was cured, one of these two frames was applied with acrylic over the adhesive as the second coating layer of the frame. The coating amount of the adhesive and acrylic were in the range between about 0.015 lb/ft$^2$ to about 0.030 lb./ft$^2$, respectively.

After the adhesive and acrylic were cured or dried out, the two frames coated with the adhesive were fixed at the weave knots due to the bonding by the adhesive. Thus, each root stem was fastened in these frames, while the root weft and warp strips of the control frame easily shifted to one another by fingers. All root frames were placed indoors for one week prior to outdoor exposure.

After outdoor exposure for two months, the control frame turned into dark brown in color. It also changed into a quadrilateral shape. The weave strips were moveable to one another. However, all the root frames protected with the crosslinking polyvinyl acetate adhesive were intact and had no mold and no cracking. Moreover, the strips at each weave knot were tightly bonded together and cannot shift or move to one another.

After seven-month outdoor exposure, the darkened control frame had molds and surface checking and cracking on most of the root strips. Moreover, the root frame control was seriously deformed in shape. The root strips were easily moveable one another. In contrast, the root frames protected by the crosslinking polyvinyl acetate adhesive had no cracking, no mold, and no deformation in shape, no matter whether the frame was coated with or without acrylic.

Example 12

Alternatively, the tree species of the roots in Example 11 may be ash, black ash, eucalyptus, maple, willow, poplar, etc. These are just examples.

Example 13

Alternatively, the root materials of Examples 11 and 12 may be pretreated with a fire or flame retardant additive. The fire retardant may include boric acid, sodium borate, or other boron fire retardants. For instance, a solution of 2% to 15% boric acid may be pressure-impregnated for the root materials, and the treated roots are dried out. The treating pressure may be between about 20 to about 100 psi. These roots are then woven into a frame structure. After that, a crosslinking polyvinyl acetate adhesive is applied on the treated root strips. A regular water resistant paint like acrylic or alkyd is further applied on the cured crosslinking polyvinyl acetate adhesive. The coating amount of adhesive and paint is the same as that used in Example 11, respectively.

Example 14

A piece of 4 ft. by 8 ft. reed-based weaving fence was purchased commercially. The warp strips of the fence piece were reed stalks, while the weft strips were steel strings. The wefts and warps were fabricated with a plain weave structure.

All reed stalks were woven side by side and parallel to one another. The reed stalks were about ⅛ inch to about 3/16 inch in diameter with a length of 4 ft. The distance between the steel weft strings were about 3.5 inches to about 4 inches. The moisture content of all reed stalks was in the range between about 6% to about 15%.

One half of the reed fence was used as control and had no coating treatment. The other half was coated with a Type I crosslinking polyvinyl acetate adhesive. The coating amount of the adhesive was I the range between about 0.010 lb./ft$^2$ to about 0.050 lb./fe.

After the adhesive was completely cured, only half of the crosslinking polyvinyl acetate-coated area was further applied with acrylic on both faces. The coated reed fence was stored in room conditions for one week prior to outdoor exposure.

After outdoor exposure for three months, the uncoated surfaces of the reed fence as control turned into dark brown, while all the exterior surfaces of the reed fence coated with crosslinking polyvinyl acetate were intact and had no fading, no mold and no cracking.

After one-year outdoor exposure, the uncoated exterior surfaces of the reed fence control part became darker and had surface cracking. Moreover, the uncoated reed fence section was slightly deformed in shape. In contrast, the reed fence section coated with the crosslinking polyvinyl acetate adhesive had no cracking and no mold. Furthermore, this protected section was also maintained well in shape and had no change in dimension.

Example 15

Four pieces of 4 ft. by 8 ft. wood lattice fences were purchased commercially, which were fabricated with pine strips. These fences were pressure-treated with the preservative chemical of acid copper chromate (ACC). The retention of ACC in pine strips was about 0.6 lb./ft$^2$. Each pine strip was about 1½ inches in width and about ⅛ inch in thickness. For each fence piece, the pine strips were fabricated with a weave angle of +45°/−45° to the horizontal direction and formed into grids with a 5.5 inch-by-5.5 inch dimension. Each grid had a void area of about 2.75 inches by about 2.75 inches in dimension.

In this example, one fence piece was used as control. One half was used as received, while another half was coated with acrylic at both faces. The coating amount of acrylic was about 0.010 lb./ft' to about 0.060 lb./ft$^2$. The other three pieces were firstly coated with a Type I crosslinking polyvinyl acetate adhesive to cover all exterior surfaces. The coating amount of crosslinking polyvinyl acetate adhesive was in the range between about 0.020 lb./ft$^2$ to about 0.100 lb./ft$^2$. After the adhesive was completely cured, two fences were further coated with acrylic over the adhesive layer at both faces in which the coating amount of acrylic was the same as that used for the control fence. The adhesive primer and the acrylic topcoat were manually coated with a roller.

The uncoated and coated fences were stored at room temperature for one week prior to outdoor exposure. Afterwards, a garden yard was formed outdoors with these fence pieces. The bottom edge of each fence was about half inch above the ground.

After outdoor exposure for three months, the uncoated exterior surfaces of the control fence turned into brown in color and started cracking, while the acrylic coating of the control fence started having micro cracks. However, all the fences protected with crosslinking polyvinyl acetate were intact and had no mold and no cracking.

After ten-month outdoor exposure, the uncoated exterior surfaces of the control fence became darker and had more surface checking or cracking. By comparison, all the three fences coated with the crosslinking polyvinyl acetate adhesive with or without the second layer of the acrylic coating had no cracking, no mold, and no deformation in shape.

After eighteen-month outdoor exposure, the uncoated section of the control fence had serious cracking on its exterior surfaces with a dark brown color, while the acrylic coating on the control fence also started cracking. However, all three fences containing the cured crosslinking polyvinyl acetate primer were intact and had no molds, no cracking and no deformation in shape.

Example 16

Alternatively, the wood lattice fences in Example 15 may be plain and have no preservation treatment. Alternatively, they may be further coated with alkyd, urethane, epoxy, or other regular coatings or paints on the cured crosslinking polyvinyl acetate adhesive.

Example 17

Alternatively, the wood lattice fences in Example 15 may be tightly woven and have no void or gap between strips.

Example 18

Alternatively, the wood lattice fences in Example 15 may be substituted with a plain weave structure with or without preservation treatment.

Example 19

Alternatively, the preservative in Example 15 may be substituted with CCA, copper sulfate, copper chrome boron, zinc chrome, copper chrome acetic, trichlorophenol (TCP), copper naphthenate, or zinc naphthenate. These are just examples.

Example 20

Alternatively, the wood lattice fences in Example 15 may be substituted with bamboo lattice fences. The bamboo strips may be with or without a preservative treatment.

Example 21

Alternatively, the bamboo lattice fences in Example 20 may be replaced with other weave structures. They may be plain weave, twill weave, satin weave, or other weave patterns. These are just examples.

Example 22

A 2% to 15% sodium borate solution may be firstly pressure-impregnated into the wood strips in Example 16 or the bamboo strips in Example 20, and the treated strips were dried out. These strips are then woven into lattice fences. After that, a crosslinking polyvinyl acetate adhesive is applied on the treated strips. A regular water resistant paint like acrylic or alkyd may be further applied on the cured crosslinking polyvinyl acetate adhesive.

Example 23

Alternatively, the lattice fences of Examples 16 and 20 may be coated or pressure-treated with other fire or flame retardant additives, including boric acid, borax decahydrate, disodium octaborate tetrahydrate, melamine phosphate, mono or diammonium phosphate, ammonium sulfate, magnesium chloride, magnesium oxide, zinc oxide, or other fire retardants, or the combination thereof.

Example 24

The crosslinking polyvinyl acetate adhesive and regular coatings or paints used in the aforementioned examples may be applied on a natural strip weaving fabric product through spray coating, brush coating, extrusion coating, impregnation soaking, dipping, curtain coating, and other suitable coating methods. These are just examples.

The above natural strip or strip-based weaving products protected with a crosslinking polyvinyl acetate adhesive are herein described in certain embodiments, situations or cases which are used only for a presentation. The descriptions may be subject to changes, modifications, and substitutions without falling out of the spirit of the present disclosure.

This completes the description of the preferred and alternate embodiments of the present disclosure. Those skilled in the art may recognize other equivalents to the specific embodiment described herein.

I claim:

1. A natural strip weaving or weave product or a natural strip woven product that is coated with a crosslinking polyvinyl acetate adhesive, comprising, a plurality of strips which are longitudinal in shape and harvested or made from a fiber plant, a tree, or a crop as weave or weaving elements or units; said strips including strands, stalks, sticks, stakes, staves, stems, straws, strings, splints, shoots, bark, branches, laths, leaves, rods, roots, twigs, or wickers, or the combination thereof;

said strips working as wefts, warps, or both in formed weaving structure or pattern of said product that is not a fiber weaving or weave fabric or textile product;

wherein the crosslinking polyvinyl acetate adhesive is a Type I or Type II adhesive and at least includes a polyvinyl acetate-based adhesive resin, a crosslinking agent, and a catalyst;

wherein said adhesive is applied and cured on at least a part of exterior surfaces of said product and does not penetrate into said strips;

wherein said adhesive is crosslinked and cured at a temperature of not higher than 250° F.;

said adhesive when cured consisting of a first bonding as coating film to bond and seal the exterior surfaces of said product, and a second bonding in which said adhesive fills gaps and voids between adjacent strips at weave knots or intersections to bond and fix the strips at said knots, such that said adhesive forms into a protective coating film and is on the exterior surfaces of said product; and wherein said adhesive improves the water resistance, dimensional stability, and durability of said product.

2. The natural strip weaving or weave product of claim 1, wherein the cellulose content of said strips is in the range between about 10% to about 85%.

3. The natural strip weaving or weave product of claim 1, wherein the dry coating amount of said adhesive on said product is at least 0.005 lbs. per square foot.

4. The natural strip weaving or weave product of claim 1, wherein the solid content of said adhesive is at least 10% by weight.

5. The natural strip weaving or weave product of claim 1, wherein said adhesive includes a first adherent phase which contacts and bonds with at least a part of the exterior surface of said product and a second adherent phase which is cured and does not contact or bond to the exterior surface of said product.

6. The natural strip weaving or weave product of claim 1, wherein said adhesive has been cured after being applied on the exterior surfaces of said product and prior to contacting any other products.

7. The natural strip weaving or weave product of claim 1, wherein said fiber plant, tree, or crop includes a species of cotton, sisal, kenaf, hemp, jute, flax, reed, sorghum, sugarcane, ramie, henequen, palm, coir, corn, milkweeds, nettles, grass, seagrass, raffia, rattan or cane, rush, straw, bamboo, and wood.

8. The natural strip weaving or weave product of claim 1, wherein said strips are identical to one another in species, shape, cross-section area, thickness, or dimension.

9. The natural strip weaving or weave product of claim 1, wherein said strips are different from one another in species, shape, cross-section area, thickness, or dimension.

10. The natural strip weaving or weave product of claim 1, wherein a second coating layer of said adhesive is further applied and cured as a top layer or topcoat over a first coating layer of said adhesive which is already cured on the exterior surfaces of said product.

11. The natural strip weaving or weave product of claim 1, wherein a second coating layer of acrylic, alkyd, lacquer, latex, emulsion polymer isocyanate, epoxy, asphalt, polyurethane, urethane, polyester, vinyl ester or silicone coatings is applied on a first coating layer of said adhesive which has already been cured on the exterior surfaces of said product.

12. The natural strip weaving or weave product of claim 1, wherein the second crosslinking polyvinyl acetate coating layer when used as a top coating layer or topcoat includes a first adherent phase which bonds with the cured first crosslinking polyvinyl acetate coating layer and a second adherent phase which is cured but does not bond to the exposed exterior surface of said product or any other products or materials.

13. The natural strip weaving or weave product of claim 1, wherein said adhesive fills or penetrates into the gaps, voids, or any other open and accessible porosity areas of the adjacent strips at the weave knots or intersections, such that said adhesive bonds and fixes these intersected strips of said product.

14. The natural strip weaving or weave product of claim 1, wherein a part of the natural strips in said product are substituted with metal, alloy, thermoplastic, or polymeric strips to have a hybrid weave structure, such that these non-natural or man-made strips, no matter whether they are used as warps or wefts, must be less than 50% of said product.

15. The natural strip weaving or weave product of claim 1, wherein adjacent strips are fastened or fixed at the weave knots or intersections by a metal- or polymer-based staple, nail, rope, thread, string, or plastic zip tie; or a string, rope, or thread made from natural fibers or yarns.

16. The natural strip weaving or weave product of claim 1, wherein said product includes a chemical fire or flame retardant additive or a chemical preservative additive.

17. The natural strip weaving or weave product of claim 16, wherein said fire retardant or preservative additive is a waterborne chemical, a water dispersible oil-based chemical, or the combination thereof, such that said additive is fixed in said product by the crosslinking polyvinyl acetate adhesive through forming a protective coating film to bond and seal the exterior surfaces of said product.

18. The natural strip weaving or weave product of claim 16, wherein said chemical fire or flame retardant additive includes a zinc-, magnesium-, or aluminum-based compound or complex, a boron-, sulfur-, chlorine-, fluorine-, phosphorus-, or silicon-based compound or complex, or the combination thereof.

19. The natural strip weaving or weave product of claim 16, wherein said chemical includes a copper-, chromium-, arsenic-, zinc-, tin-, or titanium-based compound or complex, a boron-, nitrogen-, sulfur-, chloride-, fluorine-, phosphate-, or silicate-based compound or complex, or the combination thereof.

20. A natural strip weaving or weave product or a natural strip woven product that is coated with a crosslinking polyvinyl acetate adhesive as a first coating layer and a coating of acrylic, alkyd, lacquer, latex, emulsion polymer isocyanate, epoxy, asphalt, polyurethane, urethane, polyester, vinyl ester or silicone coatings as a second coating layer, comprising, a plurality of strips which are longitudinal in shape and harvested or made from a fiber plant, a tree, or a crop as weave or weaving elements or units; said strips including strands, stalks, sticks, stakes, staves, stems, straws, strings, splints, shoots, bark, branches, laths, leaves, rods, roots, twigs, or wickers, or the combination thereof;

said strips working as wefts, warps, or both in formed weaving structure or pattern of said product that is not a fiber weaving or weave fabric or textile product;

wherein the crosslinking polyvinyl acetate adhesive is a Type I or Type II adhesive and at least includes a polyvinyl acetate-based adhesive resin, a crosslinking agent, and a catalyst;

wherein said adhesive is applied and cured on at least a part of exterior surfaces of said product, such that said adhesive forms into a protective coating film on said product that includes a chemical flame or fire retardant additive or a chemical preservative additive;

wherein said adhesive is crosslinked and cured at a temperature of not higher than 250° F.;

said adhesive when cured consisting of a first bonding as coating film to bond and seal the exterior surfaces of said product, and a second bonding in which said adhesive fills gaps and voids between adjacent strips at weave knots or intersections to bond and fix the strips at said knots, wherein said adhesive does not penetrate into said strips but is on the exterior surfaces of said product; and wherein said adhesive improves the water resistance, dimensional stability, and durability of said product.

* * * * *